US007767935B2

(12) United States Patent
Kashoji et al.

(10) Patent No.: US 7,767,935 B2
(45) Date of Patent: Aug. 3, 2010

(54) BATTERY TYPE LIGHTER

(76) Inventors: Yoshihiro Kashoji, c/o Main Factory, Tokai Corporation, 3-4, Shimohara, Subashiri, Oyama-cho, Sunto-gun, Shizuoka (JP) 410-1431; Noriyuki Serizawa, c/o Main Factory, Tokai Corporation, 3-4, Subashiri, Oyama-cho, Sunto-gun, Shizuoka (JP) 410-1431

( * ) Notice: Subject to any disclaimer, the term of this patent is extended or adjusted under 35 U.S.C. 154(b) by 2 days.

(21) Appl. No.: 10/583,955

(22) PCT Filed: Sep. 18, 2003

(86) PCT No.: PCT/JP03/11963

§ 371 (c)(1),
(2), (4) Date: Jun. 15, 2006

(87) PCT Pub. No.: WO2004/076927

PCT Pub. Date: Sep. 10, 2004

(65) Prior Publication Data

US 2007/0001645 A1 Jan. 4, 2007

(30) Foreign Application Priority Data

Aug. 29, 2003 (JP) ..... 2003-305954

(51) Int. Cl.
*H05B 1/00* (2006.01)

(52) U.S. Cl. ..... 219/212; 219/268; 431/153

(58) Field of Classification Search ..... 219/202, 219/211, 262, 263, 266, 268; 431/129, 132, 431/144, 146, 153, 255; 362/802
See application file for complete search history.

(56) References Cited

U.S. PATENT DOCUMENTS 5,285,050 A * 2/1994 Blackburn ..... 219/268
5,643,480 A * 7/1997 Gustavsson et al. ..... 219/211

* cited by examiner

*Primary Examiner*—Tu B Hoang
*Assistant Examiner*—Vinod Patel
(74) *Attorney, Agent, or Firm*—Trojan Law Offices

(57) ABSTRACT

A thin battery powered lighter, which has superior portability and usable as an advertising medium, is provided. The lighter includes a thin flat case (2); a sheet type battery (3) provided within the case (2); a heating element (4) connected to the battery (3); and a power switch (5) for establishing an electrical connection between the battery (3) and the heating element (4). The case (2) includes a slide member (6) for opening and closing an ignition window (21), which is provided at a position that the heating element faces (4), and an operating button (51) for operating the power switch (5). When the ignition window (21) is closed by the slide member (6), a portion of the slide member is interposed between contact points of the switch, precluding an operation of the operating button (51). The electrical connection is enabled by operating the operating button (51) in a state in which the ignition window (21) is open.

6 Claims, 5 Drawing Sheets

BATTERY TYPE LIGHTER

This is a national stage application of PCT/JP/2003/011963 filed Sep. 18, 2003.

TECHNICAL FIELD

The present invention relates to a battery powered lighter that houses a battery therein that electrifies a resistance wire to generate heat, employed for lighting cigarettes and the like.

BACKGROUND ART

Conventional battery powered lighters mainly utilize double A or triple A batteries. Two of these batteries are housed, connected in series, to electrify a resistance wire heating element such as a nichrome wire with a voltage of 3V. The lighters are utilized by placing the heating element, which serves as an ignition source, in contact with cigarettes and the like.

There have also been proposed card type battery powered lighters in Japanese Unexamined Utility Model Publication Nos. 63 (1988)-142571 and 3 (1991)-128251. The card type battery powered lighters employ thin flat batteries or button type batteries, and have Ignition windows which are openable and closable.

Battery powered lighters are not in widespread use. This is because in comparison with gas lighters, in which fuel gas is ignited to generate a high temperature flame, the amount of energy at the resistance wire heating element is low, resulting in difficult ignition.

Battery powered lighters which utilize the double A or triple A batteries as described above enable easy battery replacement. However, the thickness of the lighter main body becomes 15 mm or greater, to house the batteries therein. Accordingly, there is a drawback in portability, as they become difficult to carry in a breast pocket, for example. In addition, if the voltage is as low as 3V, the amount of generated heat is small, resulting in a drawback that sufficient igniting function is difficult to obtain.

If a large flat surface is formed on the lighter main body, the entirety of the lighter becomes large. On the other hand, if the lighter is miniaturized, a flat surface thereof becomes small, thereby decreasing the area of a display portion for printing a name, or placing an advertisement. Therefore, miniaturization of the lighter renders the lighter unsuitable as an advertising medium.

Rechargeable batteries such as nickel hydride batteries and lithium ion batteries may be utilized. However, these batteries are expensive, so it would be difficult to apply them to a disposable advertising medium.

On the other hand, the lighters disclosed in the aforementioned Utility Model Publications comprise a slide switch for opening and closing the ignition window, which also serves as a power switch. Thereby, an electrical connection is established in a linked operation with the opening of the ignition window. This structure may lead to inadvertent switching during carriage of the lighter, which exhausts the battery and reduces the number of times that the lighter can be utilized.

DISCLOSURE OF THE INVENTION

The present invention has been developed in view of the points described above. It is the object of the present invention to provide a battery powered lighter that ensures sufficient ignition properties and number of times that the lighter can be utilized, which is thin and superior in portability, and which is employable as an advertising medium.

The battery powered lighter of the present invention comprises:

a thin flat case;

a sheet type battery provided within the flat case;

a resistance wire heating element connected to the sheet type battery; and a power switch for opening and closing the connection between the sheet type battery and the resistance wire heating element; wherein the flat case comprises: an ignition window, open at a position where the heating element faces; a slide member for opening and closing the ignition window; and an operating button for operating the power switch;

an operation of the operating button is precluded in the state that the ignition window is closed by the slide member, by a portion of the slide member being interposed between contacts of the power switch; and the power switch is capable of being closed and activated by an operation of the operating button, in the state that the ignition window is open.

It is preferable that a display portion for an advertisement and the like is provided on a flat surface of the flat case. It is also preferable that an operating portion of the slide member and the operating button are positioned adjacent to each other on the flat case. The planar shape of the flat case is capable of being formed to be of the same size as that of a package of cigarettes.

According to the battery powered lighter of the present invention, safety is ensured, due to the configuration wherein the operation button must be manipulated to establish the electrical connection with the heating element, in addition to the operation of the slide member. In addition, inadvertent establishment of the electrical connection during carriage is prevented. Therefore, wasteful consumption of the battery is eliminated, thereby ensuring a sufficient number of times that the lighter can be utilized. Further, by utilizing the sheet type battery, the thickness of the case can be made as thin as 5 mm. Therefore, commercialization of the thin battery powered lighter becomes possible, which can be placed unobtrusively in a breast pocket or a bag, that is, which is superior in portability.

Note that by utilizing the sheet type battery, the voltage rating is increased to 6V~6.3V, compared to conventional battery powered lighters, which had employed 3V batteries. Therefore, the ignition properties are markedly improved.

In addition, it is possible to form a display portion having a large area. Therefore, the area in which a name is printed, or an advertisement is placed, is increased, rendering the lighter of the present invention as a suitable low cost advertising medium.

By providing the operating portion of the slide member and the operating button adjacent to each other on the flat case, the series of operations required for ignition can be performed favorably.

DESCRIPTION OF THE PREFERRED EMBODIMENTS

Figure 1A:
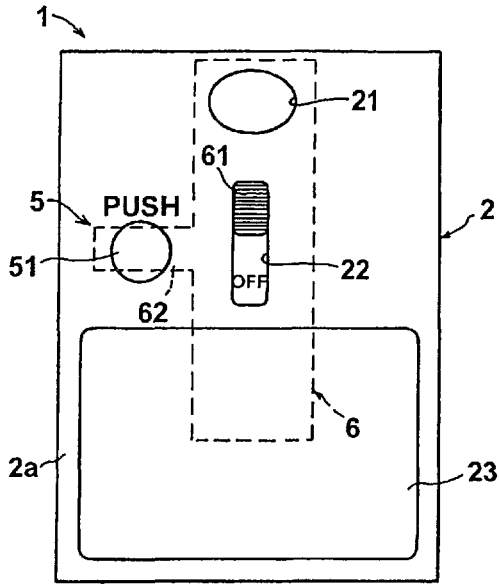
FIG. 1A is a plan view of a battery powered lighter according to a first embodiment of the present invention, in a state of non-use.
Figure 1B:
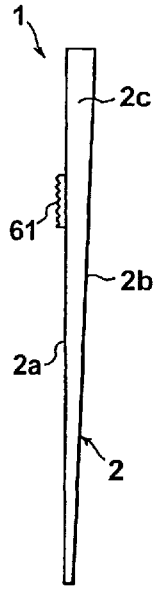
FIG. 1B is a side view of the battery powered lighter of FIG. 1A.
Figure 2:
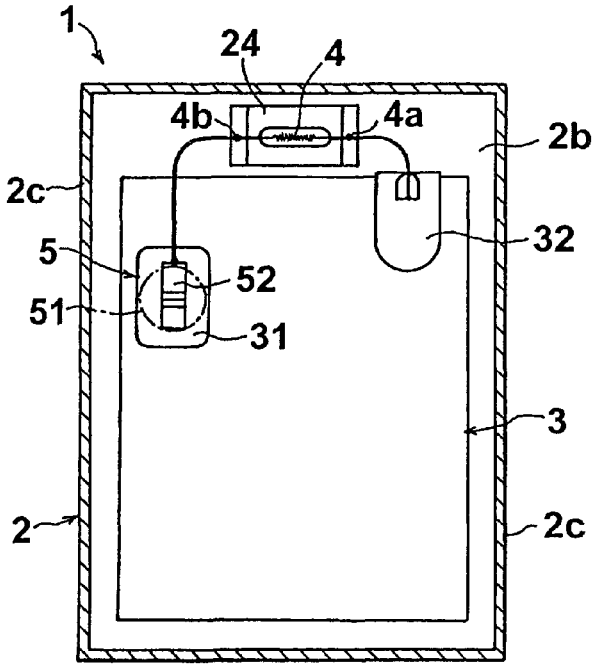
FIG. 2 is a plan view showing the internal structure of the battery powered lighter of FIG. 1A, with a case partially removed.
Figure 3:
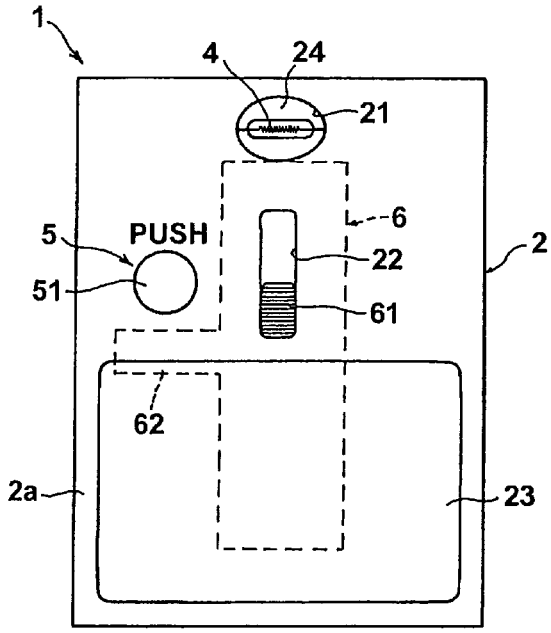
FIG. 3 is a plan view of the battery powered lighter of FIG. 1A in a state of use.
Figure 4:
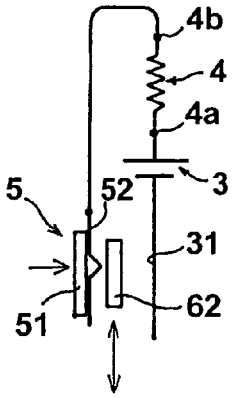
FIG. 4 is a schematic circuit diagram of the battery powered lighter of FIG. 1A.

Hereinafter, the embodiments of the present invention will be described with reference to the attached drawings. FIG. 1A is a plan view of a battery powered lighter 1 according to a first embodiment of the present invention, in a state of non-use. FIG. 1B is a side view of the battery powered lighter 1. FIG. 2 is a plan view showing the internal structure of the battery powered lighter 1, with a case 2 partially removed. FIG. 3 is a plan view of the battery powered lighter 1 in a state of use. FIG. 4 is a schematic view showing a circuit structure of the battery powered lighter 1.

The battery powered lighter 1 comprises a thin flat case 2; a sheet type battery 3 provided within the flat case 2; a resistance wire heating element 4 connected to the sheet type battery 3; a power switch 5 for establishing an electrical connection between the sheet type battery 3 and the heating element 4; and a slide member 6.

The flat case 2 comprises a front surface 2*a*, a back surface 2*b*, and lateral surfaces 2*c*. An oval ignition window 21 is provided at the upper central portion of the front surface 2*a*. A vertically extending slide opening 22 is provided at a central portion of the front surface 2*a* beneath the ignition window 21. A circular operation button 51 displaceable by pressure is provided adjacent to the slide opening 22. A display portion 23 for printing a name, an advertisement, or the like is provided at the flat surface in the lower half of the front surface 2*a*. The planar shape of the flat case 2 may be formed to be the same size as that of a package of cigarettes.

Note that the operating button 51 may be formed integrally with the front surface 2*a* of the flat case 2, to have elasticity by being formed thin. Alternatively, the operating button 51 may be formed as a separate member, and mounted on the flat case 2 to be displaceable in the direction that pressure is applied.

The heating element 4 is provided in the upper portion of the flat case 2. The thickness of the lower portion of the flat case 2 is reduced, opposed to the thickness of the upper portion thereof. The shape of the lateral walls 2*c* is that of a taper of which the height progressively decreases toward the lower portion.

The sheet type battery 3 is flat and rectangular. The sheet type battery 3 comprises a battery main body as a central layer; metal plates in the form of film, which serve as electrodes, provided on both sides of the battery main body; and insulative sheets provided as the outermost layer on both sides. The insulative sheet on the side of the front surface 2*a* is provided with an electrode opening. The portion of the metal film exposed by the electrode opening serves as a first electrode 31 of the sheet type battery. The metal film toward on the side of the back surface 2*b* is bent to overlap the insulative sheet on the side of the front surface 2*a*, to serve as a second electrode 32 of the sheet type battery 3. The voltage rating of the sheet type battery 3 is 6V~6.3V, for example.

The sheet type battery 3 described above is mounted and contained in a battery housing portion within the flat case 2. The battery housing portion excludes the upper portion of the flat case 2 at which the heating element 4 is provided. The first electrode 31 is at a position corresponding to the operating button 51 on the front surface 2*a*. The second electrode 32 is positioned at the upper right corner of the flat case 2.

The heating element 4 is constructed by nichrome wire or the like. The heating element 4 is attached to a fixing portion 24, which is provided at the central upper portion of the flat case 2, at a position that faces the ignition window 21. The fixing portion 24 is constructed by a heat cured resin, and has heat resistant properties. A first terminal 4*a* of the heating element 4 is connected to the second electrode 32 of the sheet type battery 3. A second terminal 4*b* of the heating element is connected to a terminal plate 52 of the power switch 5.

The terminal plate 52 is fixed to the back surface of the power switch 5, to face the first electrode 31. When the operating button 51 is depressed, the terminal plate 52 contacts the first electrode 31, to establish an electrical connection between the sheet type battery 3 and the heating element 4. The heating element 4 generates heat and a cigarette or the like is placed in contact therewith to perform ignition. When the operating button 51 is released, the terminal plate 52 is separated from the first electrode 31 due to the elasticity of the operating button 51 in the direction toward which it protrudes. The electrical connection is broken at the power switch 5, and the supply of electricity to the heating element 4 is ceased.

In addition, a lock portion 62, which is integral with the slide member 6, is interposed between the terminal plate 52 and the first electrode 31 when the slide member 6 is in the position at which it closes the ignition window 21. Therefore, an electrical connection is not established by the power switch 5 even if the operating button is depressed, when the ignition window 21 is closed.

That is, the slide member 6 is provided to be slidable in the vertical direction along the interior surface of the front surface 2*a* of the flat case 2. The slide member 6 is formed to be long in the vertical direction. A slide operating portion 61 is protrusively provided at the approximate center of the slide member 6. The operating portion 61 is inserted into the slide opening 22 of the front surface 2*a*, to enable the slide member 6 to be manipulated to move in the vertical direction. In the state shown in FIG. 1, wherein the operating portion 61 is moved in the upward direction, the upper end of the slide member 6 closes the ignition window 21. In the state shown in FIG. 3, wherein the operating portion 61 is moved in the downward direction, the upper end of the slide member 6 is positioned below the ignition window 21, thereby opening the ignition window 21 to expose the interior heating element 4.

The slide member 6 also comprises the lock portion 62, which extends toward the operating button 51 of the power switch 5, from the side of the slide member 6. As shown in FIG. 4, the lock portion 62 is insertable between the terminal plate 52 and the first electrode 31. In the state shown in FIG. 1, wherein the slide member 6 is in its upper position, the lock portion is interposed between the contact points of the power switch 5. Therefore, the electrical connection between the sheet type battery 3 and the heating element 4 to be established by the power switch 5 is blocked. On the other hand, in the state shown in FIG. 3, wherein the slide member 6 is in its lower position, the lock portion separates from the terminal plate 52 of the power switch 5. In this state, the electrical connection between the sheet type battery 3 and the heating element 4 is capable of being established.

As described above, in the state that the ignition window 21 is closed by the slide member 6, the lock portion 62 is interposed between the contact points of the power switch, thereby precluding manipulation of the operating button 51. On the other hand, in the state that the ignition window 2 is opened by the slide member 6, ignition is enabled by depressing the operating button 51 to establish the electrical connection at the power switch 5. This structure prevents battery consumption by inadvertent establishment of the electrical connection at the power switch 5.

The operating portion 61 of the slide member 6 and the operating button 51 are positioned adjacent to each other on the flat case 2. The sliding operation of the slide operating portion 61 to open the ignition window 21 and the depressing operation of the operating button 51 are easily performed as a continuous operation. Thereby, the ignition operation is facilitated.

The battery powered lighter 1 described above is disposed without the battery being recharged or replaced, when the sheet type battery 3 runs out and ignition is no longer possible.

A name or an advertisement can be placed in the display portion 23 of the battery powered lighter 1 of the first embodiment. Therefore, in addition to employing an ignition function for lighting cigarettes and the like, the battery powered lighter 1 may be employed as an advertising medium, thereby increasing its utility.

Figure 5:
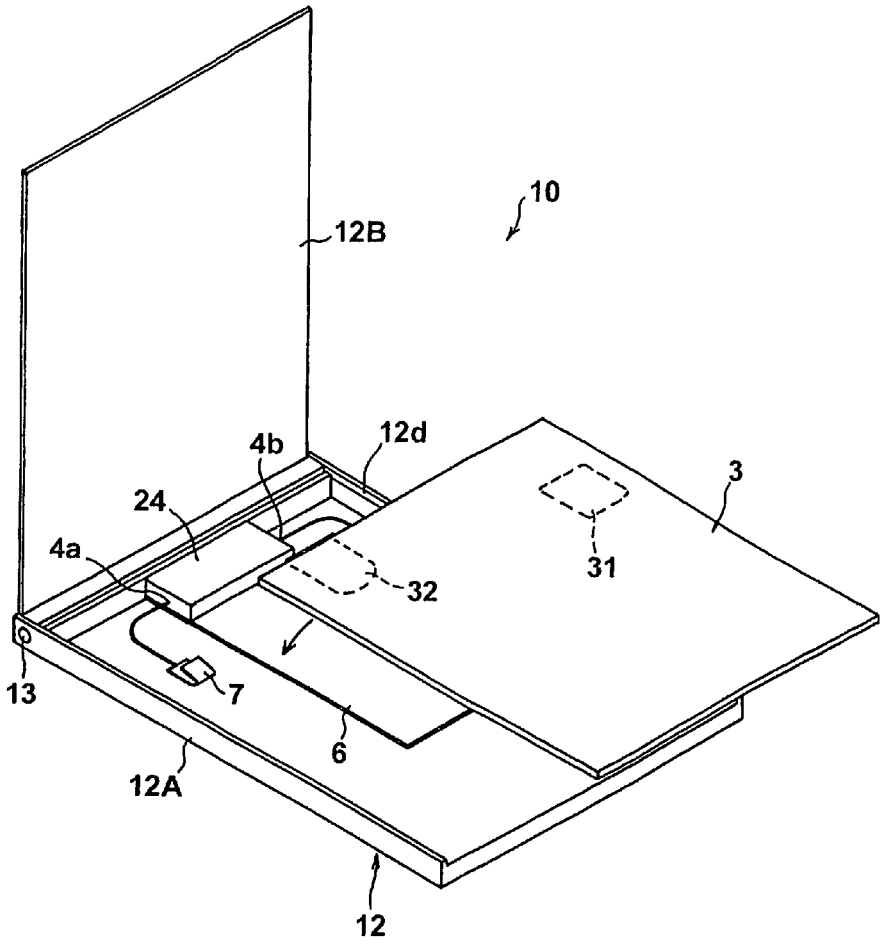
FIG. 5 is a perspective view of a battery powered lighter according to a second embodiment of the present invention, during battery replacement.

FIG. 5 is a perspective view of a battery powered lighter 10 according to a second embodiment of the present invention. The battery powered lighter 10 of the second embodiment replaceably houses a sheet type battery 3, and FIG. 5 shows a state of battery replacement. Structural components which are the same as those of the first embodiment are denoted with the same reference numerals, and descriptions thereof will be omitted insofar as they are not necessary.

The battery powered lighter 10 of the second embodiment is equipped with a flat case 12 for replaceably housing the sheet type battery 3. The flat case 12 comprises: a case main body 12A formed of a rectangular front surface and lateral surfaces around the periphery thereof; and an openable and closable lid 12B as a back surface of the flat case 12.

The lid 12B is rotatably mounted to the case main body 12A by a shaft 13. Undercuts 12*d* are formed in the interior surfaces of the lateral surfaces of the case main body 12A. When the lid 12B is closed, it engages with the undercuts 12*d*, to prevent opening of the lid 12B.

Note that although not shown in the figure, an ignition window 21, a slide opening 22, an operating button 51, a display portion 23 and a slide member 6 are provided on the front surface of the case main body 12A, as in the first embodiment.

A heating element 4 (not shown) is fixed to a fixing portion 24 provided at the central upper portion of the case main body 12A, in the same manner as in the first embodiment. A first terminal 4*a* of the heating element 4 is connected to a terminal plate 7. The terminal plate 7 is provided in the case main body 12A at a position corresponding to a second electrode 32 of the sheet type battery 3 housed within the case main body 12A. A second terminal 4*b* is connected to a terminal plate 52 of a power switch, constructed in the same manner as in the first embodiment.

FIG. 5 shows the battery powered lighter 10 in a state in which the lid 12B is open. The sheet type battery 3 is mounted in the case main body 12A so that the first electrode 31 and the second electrode 32 face the front surface side, and the lid 12B is closed. At this time, the first electrode 31 faces the terminal plate 52 on the back surface of the operating button 51 with a lock portion 62 of the slide member interposed therebetween. The second electrode 32 contacts the terminal plate 7 and is electrically connected thereto.

Ignition is performed in the same manner as in the first embodiment, by operating the slide member 6 and depressing the operating button 51. In the state that ignition window 21 is closed by the slide member 6, the lock portion 62 is interposed between the contact points of the power switch 5, precluding depression of the operating button 51. On the other hand, in the state that the ignition window 21 is opened by the slide member 6, depression of the operating button 51 establishes an electrical connection between the sheet type battery 3 and the heating element 4, enabling ignition. Long term use of the battery powered lighter of the second embodiment is possible, due to the replaceability of the sheet type battery 3.

The invention claimed is:

1. A battery powered lighter comprising:

a thin flat case;

a sheet type battery provided within the flat case;

a resistance wire heating element connected to the sheet type battery; and a power switch for opening and closing the connection between the sheet type battery and the resistance wire heating element; wherein the flat case comprises: an ignition window, open at a position where the heating element faces; a slide member having a first position and a second position; and an operating button for operation of the power switch; whereas the operating button is depressed, a terminal plate contacts an electrode, to establish an electrical connection between the sheet type battery and the heating element, and as the operating button is released, the terminal plate is separated from the electrode due to the elasticity of the operating button in the direction toward which it protrudes, a lock portion integral with the slide member interposed between the terminal plate and the electrode when the slide member is in the position at which it closes the ignition window;

a first portion of the slide member covers the ignition window when the slide member is in the first position; and a second portion of the slide member slides between the terminal plate and the electrode, thereby preventing the operation of the power switch when the slide member is in the first position.

2. A battery powered lighter as defined in claim 1, further comprising:

a display portion provided on a flat surface of the flat case.

3. A battery powered lighter as defined in claim 1, wherein:

an operating portion of the slide member and the operating button are positioned adjacent to each other on the flat case.

4. A battery powered lighter as defined in claim 1, wherein:

a fixing portion of the resistance wire heating element is structured of heat cured resin.

5. A battery powered lighter as defined in claim 1, wherein:

the sheet type battery is irreplaceably housed within the flat case.

6. A battery powered lighter as defined in claim 1, wherein:

a portion of the flat case is openable and closable; and the sheet type battery is replaceably housed therein.

* * * * *